US006405415B1

(12) United States Patent
Meeks

(10) Patent No.: US 6,405,415 B1
(45) Date of Patent: Jun. 18, 2002

(54) BODY TOWEL CLIP

(76) Inventor: Susan J. Meeks, P.O. Box 2415, Winterville, NC (US) 28590

( * ) Notice: Subject to any disclaimer, the term of this patent is extended or adjusted under 35 U.S.C. 154(b) by 0 days.

(21) Appl. No.: 09/373,518

(22) Filed: Aug. 12, 1999

(51) Int. Cl.[7] ..... A44B 21/00
(52) U.S. Cl. ..... 24/511; 24/350
(58) Field of Search ..... 24/499, 500, 501, 24/507, 509–511, 350, 710.8, 710.6, 351, 352, 353, 354, 521; 2/67, 69

(56) References Cited

U.S. PATENT DOCUMENTS 749,663 A * 1/1904 De Lamater
1,115,118 A * 10/1914 Sitz
1,358,560 A * 11/1920 Kennison
1,638,979 A * 8/1927 Broking
1,946,561 A * 2/1934 Widerman
2,352,147 A * 6/1944 Clark
2,837,806 A * 6/1958 Hawie
2,927,359 A * 3/1960 Thomas, Jr.
2,960,737 A * 11/1960 Kirsch et al.
3,531,835 A * 10/1970 Paikin
3,704,469 A * 12/1972 Levy
3,922,763 A * 12/1975 Buerger
4,145,793 A * 3/1979 Berlet
4,463,482 A * 8/1984 Hawie
4,489,466 A * 12/1984 Bakker
5,148,581 A * 9/1992 Hartmann
5,363,538 A * 11/1994 Arrendiell et al.

* cited by examiner

*Primary Examiner*—James R. Brittain
(74) *Attorney, Agent, or Firm*—Mills Law Firm PLLC

(57) ABSTRACT

A body towel clip for releasably preventing separation of overlapping portions of a towel wrapped around the torso of a user, includes a pair of pivotally interconnected clamp members having barbed jaw portions interengaging in a clamped position to securely fasten overlapping towel end, the jaw portions including interengaging barbs which resist gravitational separation and activity separation of the towel ends and distribute reactive forces along the jaw to prevent damage to the pivotal connection.

11 Claims, 2 Drawing Sheets

BODY TOWEL CLIP

FIELD OF THE INVENTION

The present invention relates to clips for holding towels, and, in particular, to a towel clip for holding overlapping towel ends in place on the body of a user during normal activities.

BACKGROUND OF THE INVENTION

Bathers and swimmers oftentimes prefer to wrap themselves in a beach or bath towel for periods after swimming or bathing. During such time, they carry on related activities which have a tendency to loosen the towel resulting in slipping and/or separation. Conventional practice is to wrap the free ends of the towel in an overlapping fashion. However, inasmuch as such towels are generally larger than regular towels, the extra towel weight from the absorbed moisture tends to loosen the connection such that the same must be retightened from time to time. Moreover, normal activity creates horizontal separation forces on the folded towel also requiring requiring retightening. At the present time there are not commercially available clips for maintaining beach and bath towels securely about the wearer.

Many approaches have been taken for freely hanging smaller towels of differing shapes and sizes from various articles such as chairs, cabinets, golf bags and a variety of outdoor sporting and recreational equipment. In such applications, the clips are useful for holding the towel for their intended cleaning purposes. Generally, the towel clip need only support the towel weight during storage inasmuch as the towel is released from the clip for utilitarian use. Where greater permanence of position is desired, eyelets and other permanent fasteners have been used thereby requiring a dedicated clip and towel assembly.

For example, U.S. Pat. No. D315,675 discloses a one piece clip for holding a hanging towel when mounted on a surface. No provisions are made for clamping overlapping towel ends about the user with sufficient strength to resist separation. A similar light-weight one piece construction is disclosed in U.S. Pat. No. D298,711.

U.S. Pat. No. 5,148,581 to Dala et al. discloses a ring shaped clip for retaining a towel on a beach chair or the like. The clip uses interengaging balls to resist sliding of the freely hanging towel.

In the foregoing approaches, the unique and particular needs for securing a beach or bath towel in place on a user after bathing or swimming are not adequately addressed. Therein the towels are substantially greater in size and weight posing a weight separation problems, which is accentuated when the towels have absorbed substantial moisture. Further, normal body movements by the wearer generate substantial horizontal separation forces. Accordingly, the prior proposed clips and assemblies are not well adapted for resisting separation of the wrapped towel during normal movements. Further, separation forces are transmitted directly to a hinge connection which is oftentimes a lightweight plastic construction, that is prone to separation and breakage. Therefor, a need continues to exist for a towel clip that can be used secure in place overlapping towel ends in wrapped configuration on the body of the user and resists, during normal movement and activities, separation of the towel from the clop due to towel weight and body motion. Moreover, such a towel clip should accommodate towel sizes, designs, and fabrics selected by the wearer, present a clip design and configuration artistically harmonious with the setting, and resist degradation over long periods of use.

SUMMARY OF THE INVENTION

The present invention provides a body towel clip for securely maintaining on the torso of the user overlapping towel ends. Therein, the body towel clip comprises pivotally connected upper and lower clamp members having barbed jaws that penetrate the overlapping towel plies in the clamped position to secure the plies against vertical and horizontal separation. The barbs of the jaws additionally interengage such that towel weight and activity movements are borne directly at the clamping interface and not transmitted to the pivotal connection. The individual barbs are also configured to permit easy release of the clip from the towel after use. The towel clip construction is amenable to many artistic treatments suitable for the public or private usage thereof.

Accordingly, it is an object of the present invention to provide a towel clip for securely wrapping a body towel about a torso.

Another object of the present invention is to provide a towel clip that resists towel weight and body movement forces in maintaining a wrapped towel in desired conformance with the user.

A further object of the invention is to provide a body towel clip that is decorative in appearance, lightweight and rugged while resisting separation in use.

A still further object of the invention is to provide towel body clip having a clamping interface that securely captures overlapping towel plies and resists separation and damage to the clip hinge while being easily disengaged after use.

DESCRIPTION OF THE DRAWINGS

The above and other features and advantages of the present invention will become apparent upon reading the following detailed description taken in conjunction with the accompanying drawings in which.

DETAILED DESCRIPTION OF THE PREFERRED EMBODIMENT

Figure 1:
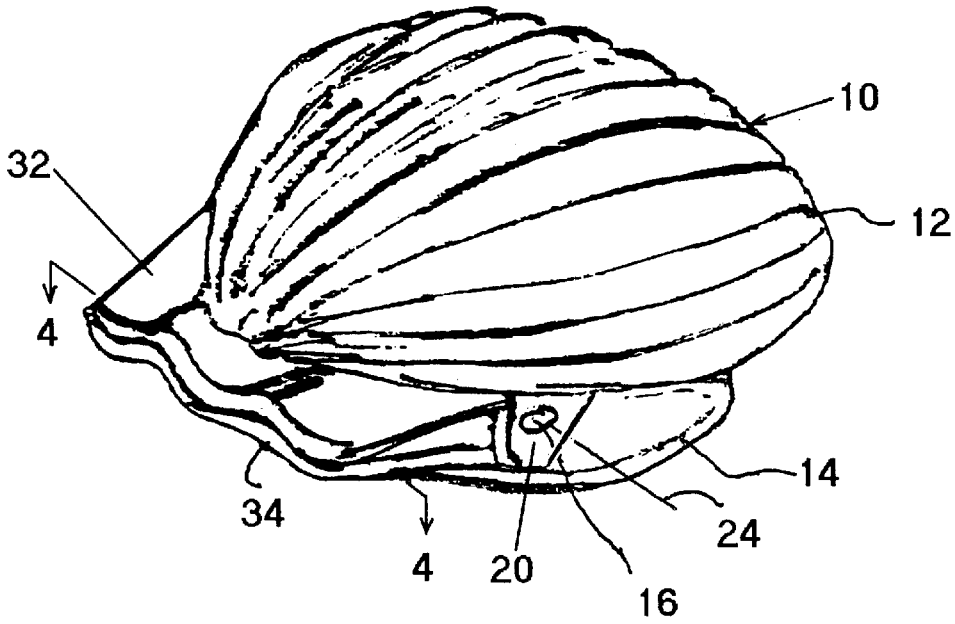
FIG. 1 is a perspective view of a body towel clip in accordance with a preferred embodiment of the invention.

Referring to the figures for the purposes on illustrating the preferred embodiment of the invention and not for limiting same, FIG. 1 illustrates a body towel clip 10 for securing in the manner hereinafter described in detail, overlapping towel ends to enable a user to wrap a beach or bath towel securely about their torso and thereafter undertake normal activities without a fear of inadvertent unwrapping. As such, the present invention finds particular application for large heavy towels associated with such use and does not require modification for or dedication to a particular design.

Figure 2:
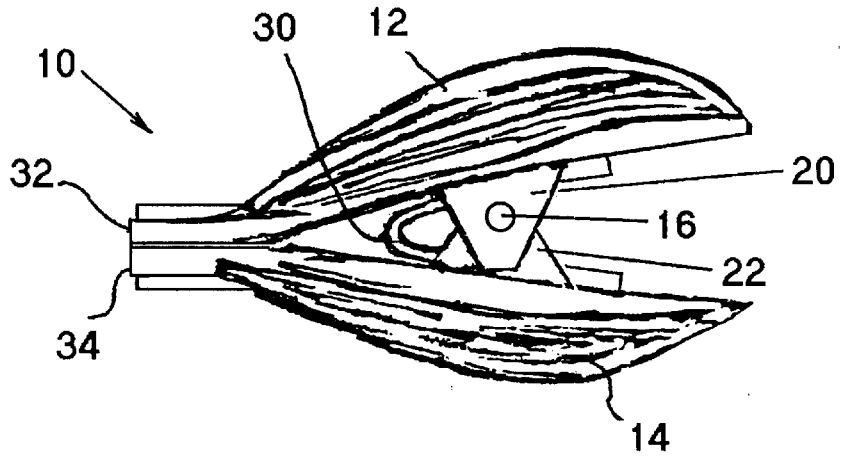
FIG. 2 is a side elevational view of the body towel clip shown in FIG. 1.
Figure 3:
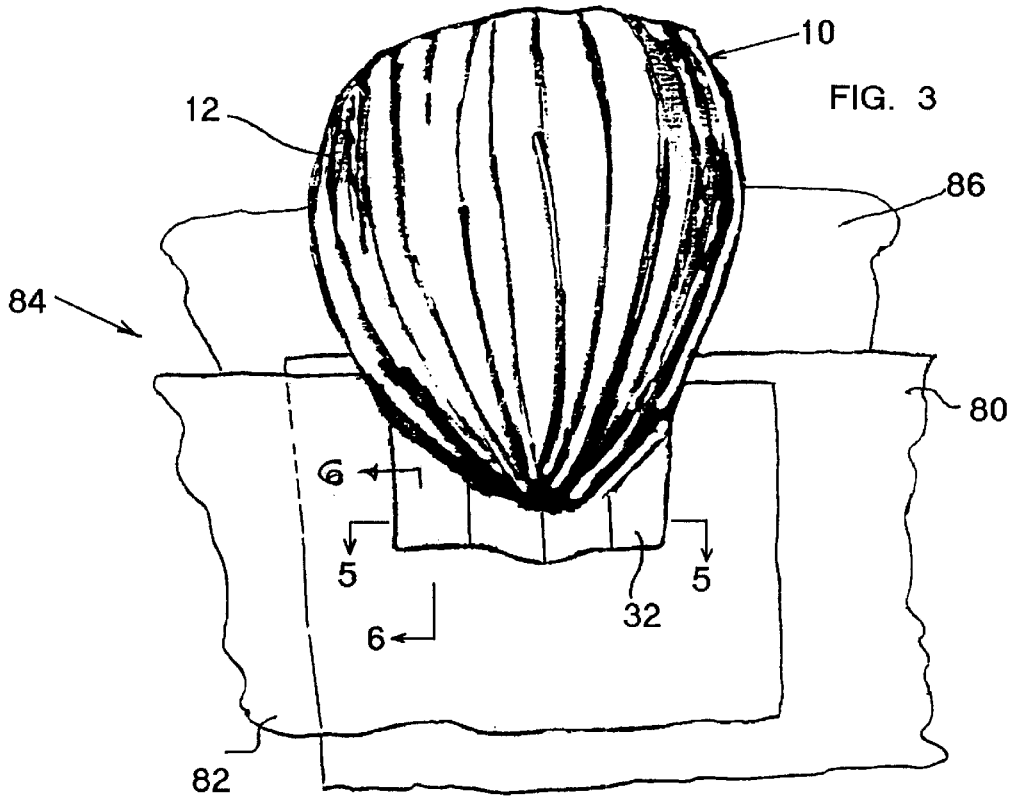
FIG. 3 is a front elevation view of the body towel clip shown in FIG. 1 holding a towel in position on a user.
Figure 5:
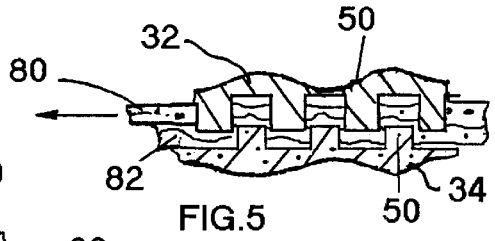
FIG. 5 is a fragmentary cross sectional view taken along line 5—5 in FIG. 3 showing the towel grabbing barbs resisting towel separating movements.

More particularly, the towel clip 10 comprises an upper clamp member 12 and a lower clamp member 14 that are pivotally interconnected by a transverse pivot pin 16 for movement between an open position, not shown, wherein overlapping towel ends may be inserted and a closed position as shown in FIGS. 2, 3 and 5 wherein towel ends are clamped therebetween. The clamp members 12 and 14 may be formed by any suitable process such as plastic molding. Additionally, the exposed faces of the clamp member 12 and 14 may bear a design motif such as the illustrated seashell configuration. Any such design motif may be directly molded into the part or may be attached thereto as a separate piece.

As shown in FIGS. 1 and 2, the lower surface of the upper clamp 12 is provided with a pair of generally triangularly shaped, downwardly depending, laterally spaced legs 20 located midway along the length thereof. The upper surface of the lower clamp 14 is provided with a pair of generally triangularly shaped, laterally spaced legs 22 located inwardly of the legs 20 and in closely spaced relationship thereto. The legs 20 and 22 are apertured to receive the pivot pin 16, the arrangement being such that the clamp members 12 and 14 are pivotally connected about a transverse axis 24 for movement between the aforementioned positions. It will be appreciated that many other forms or pivotal connections may be utilized while providing the relative motion for clamping and releasing the towel.

A U-shaped torsion spring 30 is compressively retained in the cavity between the upper clamp member 12 and the lower clamp member 14 and retained therein by suitable means such as heat staking, adhesives or mechanical means. The spring 30 serves to bias the jaws 32, 34 of the clamp members 12, 14, respectively, to the closed position with sufficient force such that the barbed jaws penetrate the towel plies as hereinafter described in detail while being sufficiently flexible to allow easy release to the open position for removing the towel. It will be appreciated that other biasing means fulfilling the above objectives maybe used.

Figure 4:
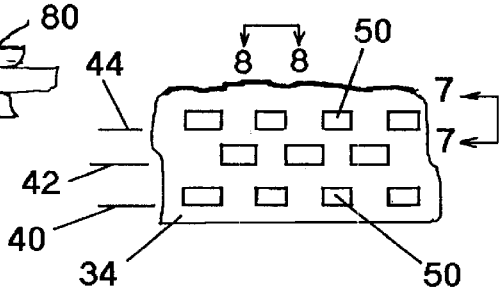
FIG. 4 is a fragmentary view taken along line 4—4 in FIG. 1 showing the towel gripping barbs on the lower clamp member.

The jaws 32, 34 of the clamp members 12 and 14 abut in the closed position as illustrated in FIGS. 1,2, at the lower distal ends of the body towel clip 10. The jaws 32, 34 in transverse profile have an undulating contour composed of alternating nested peaks and valleys and present a serpentine transverse path for assisting in retaining the towel. Referring to FIG. 4, the upper surface of the jaw of the lower clamp member 14 is provided with transverse rows 40, 42, and 44 of laterally spaced barbs 50. The barbs 50 in adjacent rows are staggered by lateral offset, although the same may be aligned in longitudinal columns. The barbs 50 in the upper jaw 34 of the upper clamp member 12 are complementarily formed to register in the closed position within the spaces between the barbs in the lower jaw 34 in closely spaced relation thereto.

Figure 7:
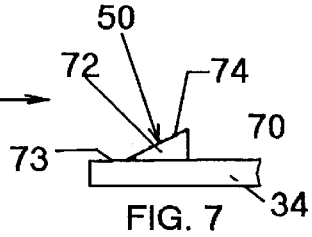
FIG. 7 is an enlarged fragmentary view taken along line 7—7 in FIG. 4 showing a side elevation view of a towel grabbing barb.
Figure 8:
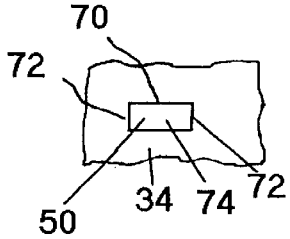
FIG. 8 is an enlarged fragmentary view taken along line 8—8 in FIG. 4 showing a plane view of the towel-grabbing barb.

Referring to FIGS. 7 and 8, each barb 50 has a generally triangular planar shape in cross section, having a vertically extending rectangular rear face 70 transverse to the jaw and planar, laterally spaced triangular side faces 72 converging at the apexes with the base surface 73 of the jaw. The lower front surface 74 is inclined toward and converges at the base surface.

Figure 6:
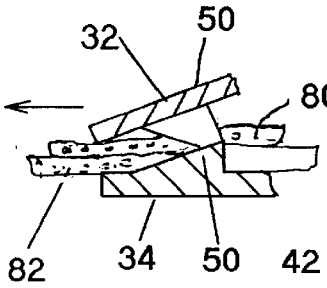
FIG. 6 is a fragmentary cross sectional view taken along line 6—6 in FIG. 3 showing the towel grabbing barbs resisting towel weight movement.

Referring to FIGS. 3, 5 and 6, a user will wrap the ends 80, 82 of a towel 84 in overlapping relation about the torso 86 and downwardly insert the towel clip 10 in the open position over the upper portions thereof. Generally when the towel edges engage the legs 20, 22 the clip is released and the spring 30 biases the clamp members 12, 14 to the closed position about the pivot pin. In the clamped position, the barbs 50 penetrate and deform the abutted towel ply and penetrate and/or deform the other towel ply in the serpentine path prescribed by the abutting jaw surfaces. In the clamped position, the weight of the towel 84 is borne by the plurality of the rear faces of the barbs and securely resists the gravitational forces of the towel's weight as indicated by the arrows. Accordingly, relative vertical movement of the towel ends is resisted.

In the clamped position, relative horizontal movement of the towel ends 80, 82 is resisted by the side faces 72 of the barbs 50, which have penetrated and deformed the towel plies and accordingly resist unwrapping movement of the towel during normal movements and activities of the towel wearer. Moreover, the above interengagement of the barbs in the closed position is such that the horizontal forces are transmitted in shear across the barbs, thus limiting any torsional forces at the pin 16 which could cause breakage or separation.

The barbs 50 also facilitate easy removal of the clip 10 and release of the towel 84 after use. By pivoting the towel body clip 10 to the open position upwardly moving the towel ends relative to the jaws 32,34, the inclined barb surfaces 74 slide upwardly and out of engagement with the towel material whereby the clip may be removed and stored for subsequent use.

From the foregoing description, it will be appreciated that the body towel clip of the present invention provides penetrating and interengaging clamping surfaces that resist vertical weight forces and horizontal activity forces causing separation of a slippage between the overlapping towel ends whereby secure position on the wearer is ensured.

While the present invention has been described above with reference to the preferred embodiment, various modifications thereof will be apparent and according the invention is to be interpreted solely in accordance with the following claims.

What is claimed:

1. A body towel clip for releasably preventing separation of overlapping potions of a towel wrapped around the torso of a user in a wearing position, comprising:

a towel having a first end and a second end that overlap in said wearing position;

a first clamp member formed of a plastic material and having a first jaw section;

a second clamp member formed of a plastic material and having a second jaw section, said jaw sections having a serpentine configuration;

hinge means pivotally interconnecting said first clamp member with said second clamp member for rotation about a transverse axis between an open position whereat said jaw sections are spaced for receiving said towel ends therebetween and a closed position whereat said first jaw section engages said first end of said towel and said second jaw section engages said second end of said towel;

a U-shaped spring formed of flat material coacting between said first clamp member and said second clamp member, said spring normally biasing said first jaw section and said second jaw section to said closed position for clamping said ends of said towel therebetween, said spring having a first end and a second end interconnected at a reversely bent middle section, said first end of said spring being mechanically connected to said first clamp member and said second end of said spring being mechanically connected to said second clamp member with said middle section being located forwardly between said jaw sections and said hinge means;

at least two spaced rows having evenly spaced projecting barbs transversely formed across said first jaw section;

at least two spaced rows of evenly spaced projecting barbs transversely formed across said second jaw section, said rows on said first jaw section being offset from said barbs on said second jaw section; and said barbs having a sufficient length for penetrating and deforming said end portions of said towel in said closed position thereby resisting horizontal separation of said end portions of said towel and said spring limiting transmission of towel forces to said hinge means due to movement activities of the user.

2. The body towel clip as recited in claim 1 wherein said barbs are positioned in lateral rows.

3. The body towel clip as recited in claim 2 wherein said barbs are laterally offset from barbs in adjacent rows.

4. The body towel clip as recited in claim 3 wherein said barbs are triangularly shaped in transverse cross section.

5. The body towel clip as recited in claim 2 wherein said barbs have a planar base transverse to said jaw sections for resisting vertical separation of said ends of said towel.

6. The body towel clip as recited in claim 5 wherein said barbs have triangularly shaped planar side surfaces for resisting horizontal separation of said ends of said towel.

7. The body towel clip as recited in claim 6 wherein said barbs transversely overlap such that separation forces from said ends of said towel are borne by the barbs to the substantial exclusion of said hinge means.

8. The towel body clip as recited in claim 7 wherein said barbs have upper rear planar rear surfaces resisting separation of said ends of said towel due to the weight of the towel and planar side surfaces resisting horizontal separation of said ends of said towel due to movement activities of the wearer, said barbs having downwardly inclined surfaces facilitating disengagement of said barbs from said ends of said towel for removal of the clip therefrom.

9. A body towel clip for releasably preventing separation of overlapping potions of a towel wrapped around the torso of a user in a wearing position, comprising:

a towel having a first end section and a second end section that overlap in said wearing position;

a first clamp member formed of a plastic material and having a first jaw section;

second clamp member formed of a plastic material and having a second jaw section;

hinge means pivotally interconnecting said first clamp member with said second clamp member for rotation about a transverse axis between an open position whereat said jaw sections are spaced for receiving said towel end sections therebetween and a closed position whereat said first jaw section engages said first end section of said towel and said second jaw section engages said second end section of said towel;

a spring formed of flat material coacting between said first clamp member and said second clamp member, said spring normally biasing said first jaw section and said second jaw section to said closed position for clamping said end sections of said towel therebetween, said spring having a planar first end and a planar second end interconnected at a reversely bent U-shaped middle section, said first end of said spring being mechanically connected to said first clamp member and said second end of said spring being mechanically connected to said second clamp member with said middle section being located forwardly between said jaw sections and said hinge means;

at least two spaced rows having of evenly spaced projecting barbs transversely formed across said first jaw section;

at least two spaced rows of evenly spaced projecting barbs transversely formed across said second jaw section; and said barbs having a sufficient length for fully penetrating one end of said towel and at least partially penetrating the other end of the towel in said closed position.

10. The body towel clip as recited in claim 9 wherein said first clamp member bears a decorative motif.

11. The body towel clip as recited in claim 10 wherein said decorative motif is in the form of a scallop.

* * * * *